United States Patent [19]

Prouse et al.

[11] 4,005,718

[45] Feb. 1, 1977

[54] SMOKING MATERIALS

[75] Inventors: Ronald Earnest Prouse, Upminster; Anthony Alfred West, Basildon; Derek Anthony King, Ferrers; Roger Poulson, Billericay, all of England

[73] Assignee: Carreras Rothmans Limited, England

[22] Filed: Jan. 2, 1976

[21] Appl. No.: 646,327

Related U.S. Application Data

[60] Division of Ser. No. 385,694, Aug. 6, 1973, Pat. No. 3,951,155, which is a continuation-in-part of Ser. No. 159,741, July 6, 1971, abandoned.

[30] Foreign Application Priority Data

July 11, 1970 United Kingdom ..... 33784/70
May 20, 1971 United Kingdom ..... 16129/71

[52] U.S. Cl. ..... 131/140 C
[51] Int. Cl.[2] ..... A24B 3/14
[58] Field of Search ..... 131/140, 140 C, 17, 131/15, 2

[56] References Cited

UNITED STATES PATENTS

| | | | |
|---|---|---|---|
| 2,769,734 | 11/1956 | Bandel | 131/17 AC |
| 3,003,895 | 10/1961 | Grunwald | 131/17 |
| 3,385,303 | 5/1968 | Hind et al. | 131/17 |
| 3,545,448 | 12/1970 | Mormon et al. | 131/2 |

FOREIGN PATENTS OR APPLICATIONS

| | | | |
|---|---|---|---|
| 687,507 | 3/1967 | Belgium | 131/2 |
| 1,157,574 | 7/1969 | United Kingdom | 131/140 C |

*Primary Examiner*—Robert W. Michell
*Assistant Examiner*—V. Millin
*Attorney, Agent, or Firm*—Roylance, Abrams, Berdo & Kaul

[57] ABSTRACT

A smokeable material comprises a base material, consisting of calcium-alginate fibers, and additional material which renders the smokeable material suitable for use in place of smoking tobacco. The additional material may consist of tobacco alone, but alternative or other additional materials include cellulosic fibers (wood pulp), a coloring agent, a nicotine donor, flavor-modifiers, and a burning sustainer. It is also disclosed that calcium-alginate fibers will (unexpectedly) papermake in the traditional manner used for non-synthetic fibers, and the above additional material may, or may not, be incorporated during such papermaking. Any incorporated tobacco is preferably 55% or less, by weight, added by blending or otherwise. Where there is no tobacco, there may be preferably (by weight) at least 80% of calcium-alginate fibers, and 10% each of the cellulosic fibers, and total other constituents.

27 Claims, 1 Drawing Figure

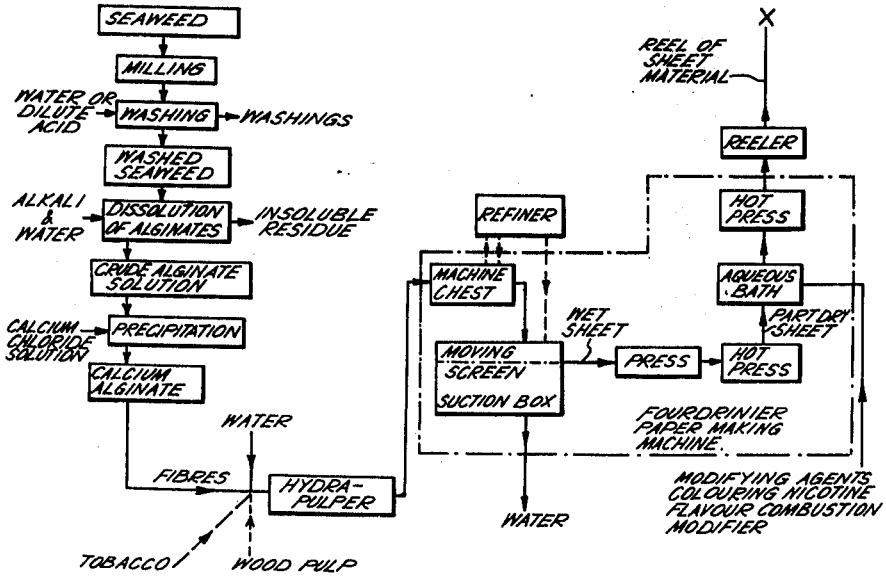

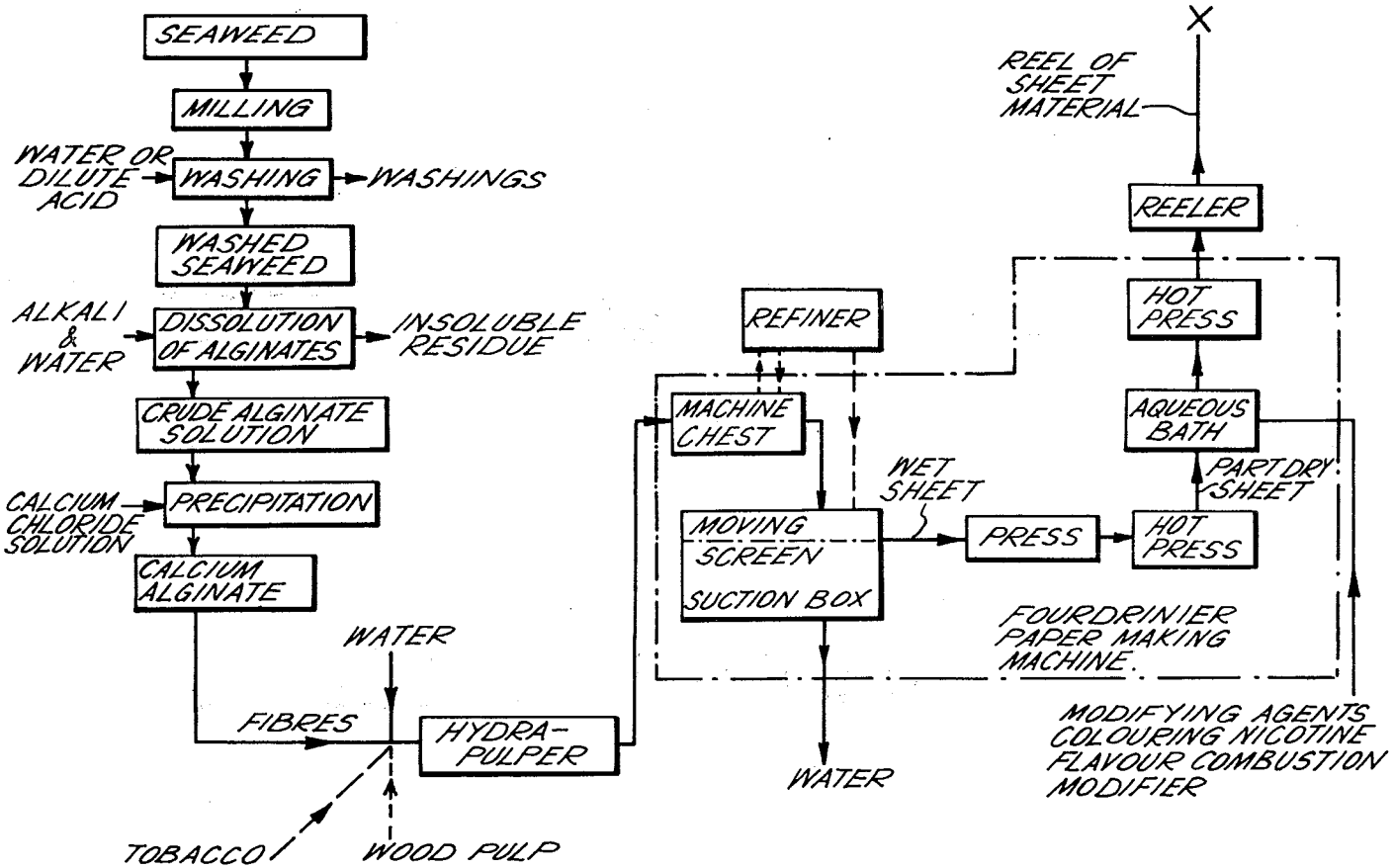
SEAWEED
MILLING
WASHING
WASHINGS
WATER OR DILUTE ACID
WASHED SEAWEED
DISSOLUTION OF ALGINATES
INSOLUBLE RESIDUE
ALKALI & WATER
CRUDE ALGINATE SOLUTION
PRECIPITATION
CALCIUM CHLORIDE SOLUTION
CALCIUM ALGINATE
WATER
FIBRES
HYDRA-PULPER
WOOD PULP
TOBACCO
REFINER
MACHINE CHEST
MOVING SCREEN
SUCTION BOX
WATER
WET SHEET
PRESS
HOT PRESS
PART DRY SHEET
AQUEOUS BATH
HOT PRESS
HOT PRESS
REELER
REEL OF SHEET MATERIAL
X
FOURDRINIER PAPER MAKING MACHINE.
MODIFYING AGENTS
COLOURING NICOTINE
FLAVOUR COMBUSTION
MODIFIER

SMOKING MATERIALS

This application is a division of Ser. No. 385,694, filed Aug. 6, 1973, now U.S. Pat. No. 3,951,155 which was a continuation-in-part of application Ser. No. 159,741 filed July 6, 1971, now abandoned.

This invention relates to smoking materials sometimes known as tobacco substitutes and to processes of making such smoking materials which materials may be used together with or in place of tobacco in smoking products such as cigarettes, cigars and pipes.

The prior art discloses the use of a number of materials as tobacco substitutes. However, as reported by A. A. Shmuk in "The Chemistry and Technology of Tobacco", published by Pishchepromizdat, Moscow, 1953, at page 588 of the translation by National Science Foundation, 1961, PST Cat 96, when substituting any smoking material for another it is impossible to predict the effect upon the composition of the smoke and the properties of the smoke: thus, even when the chemical composition of the proposed substitute is close to that of the tobacco plant, there is no assurance that the chemical composition and properties of the smoke will be analogous to those of tobacco smoke.

Belgian Pat. No. 687,507 suggests that smoking materials shall have excluded from them the natural cellulose of tobacco, i.e. tobacco itself is to be excluded. Instead, a smoking material (it is suggested) shall consist of a structural substance impregnated with tobacco extract. This structural substance might be "cellulose which is as pure as possible (alpha-cellulose) or the ester of cellulose, regenerated cellulose, viscose, other polycarbohydrates such as alginates, and, to a certain extend, non-combustible ((it is stated)) synthetic substances such as polyvinyl alcohol or polyolefines". The structural substance might be in a variety of physical forms such as fibres, threads, filaments, powder, foams, sponges, tissues, tapes, films, gauze, and other suggested forms.

U.S. Pat. No. 3,461,879 to Kirkland discloses, for cigarettes, a tobacco material made from one particular species of oxidized cellulose when together with a burning-inhibiting hydrate. The tobacco substitute may be blended with tobacco and may include other modifying agents such as flavoring agents, and compounds which further modify the burning.

U.S. Pat. No. 2,769,734 to Bandel discloses a process for forming a sheet from tobacco dust with the aid of an adhesive film-forming agent which "may be dispersed in water" and which is "preferably a polysacchoride and is usually water-dispersible in the first step of forming the sheet according to the invention". The Example 4 describes the preparation of an aqueous "binder mixture" consisting of a colloidal dispersion of (water-insoluble) calcium alginate, necessarily in the presence of (a "stoichiometric" excess of) water-soluble sodium alginate, and cigarette paper pulp fibre. In the finished tobacco sheet, the adhesive formulation may be between 0.5% and 33% by weight, but is preferably between 1% and 20% by weight.

U.S. Pat. No. 2,592,554 to Frankenburg discloses the manufacture of a reconstituted tobacco sheet from pulverized tobacco with the aid of a water-soluble acid polysaccharide compound such as sodium alginate or potassium alginate.

U.S. Pat. No. 3,529,602 to Hind et al discloses a tobacco substitute sheet material, from which tobacco is preferably excluded. The product includes a film-forming ingredient comprising a pectinaceous or an alginic material or the like and preferably derived from tobacco plant parts, and a mineral ingredient comprising an alkali metal salt or an alkaline earth metal salt or a clay. The composition may be cast into a film, or may be extruded in fibrous form (i.e., as pseudo-fibers having the appearance of true fibers) or in sheet form or in other shapes.

British Pat. No. 1,157,574 discloses a method which may be used to form reconstituted tobacco sheet. Pulverized tobacco is suspended in an aqueous solution of a water-soluble alginate such as sodium alginate. A selected multivalent cation, such as calcium (among various possible cations listed), is then so introduced that a gel of a water-soluble alginate, such as calcium alginate, forms in such a controlled manner that the tobacco dust becomes trapped within the gel. The gel is then rolled and dried to form the reconstituted tobacco sheet.

British Pat. No. 626,518 discloses that hand-made paper can be made from certain waste-fibers, and British Pat. No. 632,050 discloses that paper can be made from certain waste-fibers on a papermaking machine: in each case, the exact nature of the waste-fibers in question is not made clear. They appear to be waste-fibers rejected as unsuitable for use in the manufacture of fabrics: the first patent refers to them, probably somewhat inaccurately, as "calcium-alginate fibers", whilst the second patent states that "the main compound present is calcium alginate". Each of the two patents states that these waste-fibers and paper made from them are "non-inflammable", this being defined in the first patent to mean "it does not burn with a flame or propagate combustion, although it may char under heat". British Pat. No. 672,896 discloses that "calcium alginate having a pronounced fibrous structure" can be used "in the paper industry as a supplementary or filler material".

According to the present invention there is provided a smokeable material comprising a base material together with additional material which provides both a minor proportion of flavor-modifying agent and a combustion modifier, the additional material being incorporated so as to communicate selected flavor to and to allow the burning of the smokeable material in such manner as to render the smokeable material suitable for use in place of smoking tobacco, in which the base material is calcium-alginate fibers.

Conveniently, the calcium-alginate fibers in the smokeable material are selectively in the form of paper and in a form got by mechanically-dividing paper.

A preferred method of manufacture of the smokeable material includes the steps of forming sheet-material from a stock by steps including the steps of mechanically working calcium-alginate fibers in the presence of water so as to disperse those fibers and to hydrate them and to provide the stock, and presenting the stock to the web-forming unit of a papermaking machine, the said additional material being incorporated into the smokeable material either prior to and/or subsequent to the said presentation of the stock to the web-forming unit. The web-forming unit may be of the Fourdrinier type. The paper thus formed, in which of course the water-insoluble calcium alginate is present as fibers, may be used either directly, or after it has been mechanically divided, as the smokeable material.

The water-insoluble calcium-alginate fibers which, according to the invention, constitute the base material of the smokeable material, cannot usually, alone, be made to burn "in such manner as to render" them, along, "suitable for use in place of smoking tobacco". In other words, those fibres, alone, are not (what may be termed) smokeably burnable. The problem is not necessarily merely one of discovering suitable "additional material" which, per se, is known to promote combustion, although this is one expedient. More generally, the problem is to produce smokeable material, i.e. smokeably burnable material, comprising a mixture of calcium-alginate fibers and "additional material", which mixture proves to be smokeably burnable. Thus, we have found, for example, that calcium-alginate fibers and "additional material" in the form of potassium nitrate together with a certain flavor-modifying agent and together with a certain coloring agent, is smokeably burnable in cigarettes: in such a case, it is necessary to remember that that smokeable burnability cannot necessarily be simply attributed to the potassium nitrate, but is almost certainly an attribute of the final product mixture, i.e. it is caused by the mutual interaction of all of the additional materials and, also, the calcium-alginate fibers. Thus, in our expression "combustion modifier", the "combustion" referred to is that of the product smokeable material, and it is that combustion which is so "modified" (as compared to the lack of smokeable burnability of the calcium-alginate fibers alone) that the product material is smokeable burnable. We have also found that a suitable "additional material" may be tobacco alone, itself not necessarily in a minor proportion: in such case, the tobacco may be considered to provide "both a minor proportion of flavor-modifying agent and a combustion modifier".

The smokeable material may conveniently (but not necessarily) include cellulosic fibers, these having been mechanically worked with the water-insoluble calcium-alginate fibers in the presence of water to disperse and hydrate the fibers and to cause the calcium-alginate fibers and the cellulosic fibers to be intimately associated with one another upon forming the fibers into sheet material by means of the papermaking machine. Preferably, high-grade wood pulp is used and preferably the cellulosic fibres comprise not more than 10% by weight of the fibers used.

The mechanical working may be carried out in a machine (stock-preparing apparatus) in the form of a tank-type pulper called a Hydrapulper (Registered Trade Mark) in which a rotor provided with pulping vanes mechanically works the fibers in the presence of water to form a pulp of the required consistency.

It has been found in practice that the said mechanical working is preferably stopped when the pulp freeness is in the range 20° – 50° Schopper-Reigler (as sampled with a 7% cup).

A typical papermaking machine, as indicated within the chain line of the accompanying drawing, is most conveniently regarded as comprising a sequence of series-arranged units arranged to operate continuously. The said pulp, and quantities of water, are introduced into a machine chest (reservoir) so as to provide the said stock. This stock is metered on to the moving endless "wire" (screen) of a Fourdrinier-type web-forming unit which acts (for example, with the aid of a section-box) to remove water to form the web. This web is passed through first a cold press (the press section) and then a hot press and, in partially dried form, is then presented to an applicator (which may comprise an aqueous bath from which, see below, material may be incorporated into the paper sheet). Further drying is then effected in a second hot press. (In ordinary papermaking, the applicator is employed to add "size" to the partly-dried sheet.)

The presentation of the stock to the web-forming unit of the papermaking machine may be so arranged that the resulting dried sheet preferably has an average basis-weight in the range 50 – 250 gm/m$^2$. (In Britain, sheet having a basis-weight greater than 200 gm/m$^2$ is technically referred to as paperboard rather than paper.)

The smokeable material may conveniently include a coloring agent, which coloring agent is preferably a tobacco-like brown or yellow-brown. Among the useable colors are those certified by the Food and Drug Administration of the United States of America, for example FD & C 1596 Brown and FD & C Yellow No. 5.

Alternatively, but preferably additionally, the smokeable material may conveniently include nicotine supplied for example as the sulfate, citrate, or citrate-sulfate, malonate or malate, as the presence of this alkaloid gives an increased feeling of satisfaction to smokers.

The flavor-modifying agent in the smokeable material may be or include flavoring agent such as is used commercially in flavoring pipe tobacco, for example : powdered deer tongue, licorice or other proprietory flavoring mixture commercially available.

The smokeable material may include up to 2% by weight of citric acid which in addition to modifying the flavor also serves to reduce the volatility of nicotine if the latter is included.

The smokeable material may include an inorganic salt e.g., sodium nitrate or potassium nitrate, which may be provided as necessary to sustain the burning of the smokeable material, particularly where the material is used in a cigarette, during the rest period of smoking, i.e., when air is not forcibly drawn through the burning zone of the smokeable material.

The additional materials mentioned in the preceding five paragraphs may be added to the beaten pulp, i.e., after it has been treated in the Hydrapulper (Registered Trade Mark), but it has been found preferably to apply all of these materials to the sheet material from the said aqueous-bath applicator.

The said additional material incorporated into the smokeable material during the process of manufacture may include or consist of tobacco. Such added tobacco, itself not necessarily in a minor proportion, may wholly or in part serve as the source of the said both a minor proportion of flavor-modifying agent and a combustion modifier.

The tobacco may conveniently be incorporated into the smokeable material before the mechanical-working operation and may conveniently then be in the form of granules or fibers derived from the main stems, roots or midrib stems of the leaf known as petioles.

Alternatively or in addition, finely-ground tobacco preferably of a particle size between 5 and 10 microns may be added to the said aqueous-bath applicator of the papermaking machine with the other additional material as mentioned above, or possibly may be incorporated as a coating to the dried sheet material from a separate aqueous-bath applicator through which the dried sheet is passed and thereafter redried, as by a further hot press or an electric air blower or infra-red heating tunnel. To level out the coating, so-called doctor blades or an air-knife may be used.

Where the tobacco added at any stage in the process of forming the sheet material or as a coating to the sheet is of the type of which the juice is acid or alkaline, buffer agents are added, for example, sodium citrate or sodium acetate to control the pH value as required.

Preferably, where tobacco is not added during the sheet forming, the calcium-alginate fibers will be the major constitutent, preferably over 80% by weight of the sheet material, any said cellulosic fibers being preferably less than 10% by weight and the total other constituents forming a minor proportion, preferably not more than 10% by weight.

Where tobacco is added during the process of manufacture of the sheet, the proportions of tobacco in the sheet by weight will preferably be not more than 55% by weight, such high proportions being achieved by incorporating tobacco into the stock after beating. A smokeable material comprising 50% weight of tobacco has been found to be satisfactory, as in Examples 3, 4 and 5 below.

It has been found that sheet (manufactured according to the invention) which has been creped permits better packing into cigarettes and makes for more even burning. To produce this creped effect the sheet after passage through the applicator is conveniently passed through a cold press to remove any excess of solution or dispersion of material acquired from the applicator and then around a heated drying roll. During drying the solution or dispersion causes the paper to adhere slightly to the roll. The sheet is then removed from the roll by a doctor blade which acts as a creping knife. The angle and contour of the blade and the speed and soaking conditions control the coarseness of the crepe obtained.

The sheet may be cut on the usual form of tobacco cutter into thin strips having a width of 1/25th to 1/100th of an inch and may be manufactured into cigarettes either on its own or blended with tobacco or any of the usual reconstituted tobaccos.

Where the smokeable material incorporates (by blending) tobacco and/or reconstituted tobacco, the total weight of tobacco will preferably be not more than 55% by weight.

This blending may be effected by tumbling or otherwise mixing (e.g. in a turbulent air stream) the shredded said sheet-material with shredded tobacco, or by feeding tobacco and/or reconstituted tobacco sheet and a sheet of the said sheet-material together to a shredding or cutting device where the components are shredded and blended simultaneously; or by any of the variety of ways known in the tobacco blending art.

The finished smokeable material may conveniently be processed into any of the conventional forms for smoking, e.g. cigars, cigarettes and pipe tobacco.

Several examples of the process of manufacture of smokeable material according to the invention and test thereon will now be described with reference to the accompanying single-FIGURE drawing which is a diagrammatic flow sheet showing in full line one process of making such material in sheet form and, in broken line, some possible variations of the process. The papermaking machine is shown as contained within a chain line.

EXAMPLE 1

A 5% aqueous slurry of fibers comprising 95% calcium-alginate fiber (as commercially available by manufacture from seaweed for example as outline on the left-hand side of the flow sheet, this manufacture being briefly described below) and 5% high-grade wood pulp was beaten in the presence of water in a Hydrapulper (Registered Trade Mark) to separate the fiber bundles, to disperse the fibers and to hydrate them. The beating was stopped when the pulp freeness was in the range of 20° – 50° Schopper-Reigler (as sampled with a 7% cup). The pulp was then pumped to the chest (reservoir) of the papermaking machine and there diluted to 1% by weight and fed from there onto the wire (screen) of the Fourdrinier-type web-forming unit of the papermaking machine. This wire of the web-forming unit moves over a suction box and acts to remove water and the wet sheet so formed was fed to a press of the machine having sets of unheated rollers and thereafter through a hot press of the machine, i.e. having heated "cylinders" against which the paper is pressed by endless felts. The partially dried sheet was passed through the aqueous-bath applicator of the machine containing a 2.5% by weight solution of potassium nitrate to a further and similar hot press of the machine and thereafter to a reeler which winds the sheet into a roll. The resulting paper has a basis-weight of 100 gm/m$^2$.

(The left-hand side of the flow sheet is taken from the booklet "CIBA Review : Alginates : 1961/1" published by CIBA Limited, Basle, Switzerland, represented in the U.S.A. by CIBA Chemical & Dye Company, Fair Lawn, N.J. Harvested cut seaweed may be milled, and may be washed in water or dilute acid. The seaweed is then treated with alkali and water, for example in the form of an aqueous solution of sodium carbonate, whereby the alginate in the seaweed is converted into water-soluble (sodium) alginate in a crude alginate solution wherein the solid impurities may be allowed to settle as a sediment. The supernatant liquid may then be squirted through a spinnaret or other nozzle into an aqueous calcium-chloride solution to thereby precipitate crude calcium-alginate fibers. These fibers may be used directly in the present invention, or, since they tend to impart a strong characteristic odor to smokeable material, they may first be "repurified" by conversion by acid to alginic acid which is reacted with an aqueous solution of sodium carbonate to form a sodium-alginate solution which, as before is squirted through a spinnaret into an aqueous calcium-chloride solution to thereby precipitate "repurified" calcium-alginate fibers.)

The amount of solution or dispersion and the constituents of the solution taken up by the sheet from the applicator, will depend e.g., on the moisture-content and the porosity of the sheet, the length of time for which it is subjected to the applicator, and the extent to which it is pressed or squeezed after it leaves the applicator. Accordingly, it is preferable to determine the concentration of the solution by preliminary trials for each machine and sheet. If the resultant paper is too weak or too wet to be passed under tension through the applicator it may conveniently be supported on a suitable belt or screen its passage through the applicator.

The paper was thereafter shredded into strips 1/52 inches wide and approximately 1 and ½ inches long and made into experimental cigarettes using standard cigarette paper. The weight of these cigarettes ranged from 980 mg to 1,020 mg and their pressure drops from 9.6 to 12.7 cm water-gauge.

TEST 1

The cigarettes were smoked by a Cigarettes Components Limited CSM 12 smoking machine and the particulate matter from the smoke was collected on a fiberglass filter pad. Cigarettes of the same weight but will all tobacco within the standard cigarette paper were smoked simultaneously to act as a control.

| Result of Test 1 | Total particulate matter (dry) mg/cig. |
|---|---|
| Tobacco (Control) | 29.9 |
| Tobacco Substitute Cigarettes from the Sheet | 5.8 |

EXAMPLE 2

Example 1 was repeated, except that the partially dried sheet was passed through an aqueous solution contained in the aqueous bath and comprising by weight:

| | |
|---|---|
| 2.5% | FD and C 1956 Brown |
| 5.0% | Potassium Nitrate |
| 1.0% | Flavor C 146 commercially available from Bush Boake Allen Ltd., a British Company |

The sheet was shredded and the cigarettes made as in Example 1, their weight being the same. Their pressures drops ranged from 10 – 14 centimeters water-gauge.

TEST 2

The cigarettes were smoked and the particulate matter was collected as in Test 1 above with the same control.

| Result of Test 2 | Total particulate matter (dry) mg/cig. |
|---|---|
| Tobacco (Control Cigarettes) | 29.9 |
| Tobacco Substitute Cigarettes from the sheet | 5.8 |

EXAMPLE 3

A quantity of tobacco substitute prepared according to Example 2 was blended with an equal weight of shredded leaf-tobacco and then manufactured into cigarettes, again using standard cigarette paper. The weight of the test cigarettes was as in Example 1 and their pressure drops ranged from 9.7 – 12.4 centimeters water-gauge.

TEST 3

These cigarettes were smoked and the particulate matter collected as in Test 1 above with the same control.

| Results of Test 3 | Total particulate matter (dry) mg/cig. |
|---|---|
| Tobacco (Control Cigarettes) | 29.9 |
| 50% Tobacco Substitute (from the sheet) & 50% Tobacco, Cigarettes | 15.3 |

EXAMPLE 4

Cigarettes as in Example 2 were attached to a conventional filter-tip test.

TEST 4

The cigarettes were smoked and the particulate matter collected as in Test 1 above with the same control.

| Result of Test 4 | Total particulate matter (dry) mg/cig. |
|---|---|
| Tobacco (Control Cigarettes) | 29.9 |
| Tobacco Substitute Cigarettes with Filter | 3.0 |

Example 5

Cigarettes as in Example 3 were attached to a filter tip of 1 gm weight and had a pressure drop of 13.0 centimeters water-gauge.

TEST 5

The cigarettes were smoked and the particulate matter collected as in Test 1 above with a control using the same weight cigarettes with the same 1 gm weight filter but using only tobacco and no tobacco substitute.

| Result of Test 5 | Total particulate matter (dry) mg/cig. |
|---|---|
| Tobacco (Filter Control Cigarettes) | 21.0 |
| 50% Tobacco Substitute 50% Tobacco; | 12.7 |

-continued

| Result of Test 5 | Total particulate matter (dry) mg/cig. |
|---|---|
| Filter, Cigarettes | |

It has been found that the sheet-material of the above examples can be formed without the presence of the wood pulp, and that the results from such sheet-material, used to form smokeable material, compare favourably with those of the above examples.

The smokeable material as described in the above examples, on combustion produces so small a quantity of smoke for a given weight of material when compared with tobacco that it is free from pungent acrid or objectionable burning odors and is thus acceptable as a smokeable material.

The pH value during the process of making the sheet-material in the above Examples was generally controlled so as to be between approximately 6.5 and 7.5.

EXAMPLE 6

Tobacco stem, in the form of Virginia mid-rib which had been autoclaved with (5%) sodium-hydroxide solution at 30 lbs/in$^2$ for one hour and subsequently washed to remove excess alkali, was supplied to the Hydrapulper (Registered Trade Mark) with an aqueous slurry of calcium-alginate fiber (commercially available, as described in Example 1). Equal weights of the tobacco and of the calcium-alginate fibers were supplied, and the slurry of fibers was mechanically worked (with added alum to maintain the pH value at or below pH 7.0). Paper was then made in the manner of Example 1, except in that no additional material, other than the tobacco, was incorporated. During the papermaking, the (paper) sheet was easily drained of water. The resulting paper removed to be smokeably burnable.

In a modification of Example 6, tobacco in the form of ground offal was instead incorporated into the papermaking stock prior to presentation of the stock to the web-forming unit of the papermaking machine, with similar results.

It is to be understood that the calcium-alginate fibers, incorporated into smokeable material according to the invention, are true fibers: they are not pseudo-fibers as might be obtained, for example, by extending tooth-paste from a tooth-paste tube "in fibrous form" and drying the extruded material. The calcium-alginate fibers can be manipulated in processing machines, as for example cigarette-making machines, and, moreover, we have found that it is possible to papermake from them (as described) in the traditional manner used for non-synthetic fibers: the resulting paper can be manipulated in processing machine similarly to tobacco-leaf and to reconstituted tobacco sheet.

In selecting water-insoluble calcium alginate, and in particular water-insoluble calcium-alginate fibers, as the basis of a smokeable material, we have given attention to the class of alginates (some of which are water-soluble and some of which are water-insoluble) and to the various forms in which the alginates can occur.

We have selected calcium alginate, and in particular calcium-alginate fibers, because our investigations lead us to believe that it provides a unique combination of advantages as follows:

1. The inorganic content of calcium alginate, which is approximately 10% in itself, lowers the proportion of smoke (as particulate "tar" and gas phase) which will be delivered on smoking combustion, and is present as calcium is potentially non-toxic. (The human body contains a high proportion of calcium, and other products which are applied internally and externally to the human body contain calcium in significant quantities, e.g. plant and animal products). All other radicals which form water-insoluble inorganic derivatives of alginic acid are or may be toxic, either per se and/or regards their contribution to the smoke.

2. Calcium-alginate can be made readily and relatively cheaply as fibers in comparison with other alginates because of the availability of seaweed, and the availability of calcium chloride as waste material of other industrial process, from which materials calcium-alginate fibers can be manufactured.

3. Calcium-alginate fibers can be given a tobacco-like appearance.

4. Calcium-alginate fibers can be made to burn by reasonable amounts of additional material because of the high available surface area to total volume of fibers.

5. Calcium-alginate fibers can be made into paper sheet by papermaking processes during which the calcium-alginate fibers tend to become purified and which permit a product of suitable porosity, basis-weight and other physical characteristics to be obtained. Papermaking processes enable incorporation of additional material(s) and ready control of the combustion and other characteristics of the final sheet and products thereof, so (for example) permitting processing in cigarette-making conditions which may be relatively humid or wet.

What is claimed is:

1. A method of manufacturing a smokeable material comprising a base material together with additional material which provides both a minor proportion of flavor-modifying agent and a combustion modifier, the additional material being incorporated so as to communicate selected flavor to and to allow the burning of the smokeable material suitable for use in place of smoking tobacco, in which the base material is calcium-alginate fibers, which method includes the steps of forming sheet-material from a stock by steps including the steps of mechanically working calcium-alginate fibres in the presence of water so as to disperse those fibers and to hydrate them and to provide the stock, and presenting the stock to a web-forming unit of a papermaking machine, the said additional material being incorporated into the smokeable material either prior to and/or subsequent to the said presentation of the stock to the web-forming unit.

2. A method as defined in claim 1, in which the calcium-alginate fibers which are mechanically worked are obtained from seaweed by steps including the step of forming those fibers from an aqueous solution of a water-soluble alginate and an aqueous solution of calcium chloride.

3. A method as defined in claim 1, in which cellulosic fibers undergo the said mechanical-working together with the calcium-alginate fibers, whereby the cellulosic and the calcium-alginate fibers become intimately associated within the said sheet-material, the cellulosic fibers comprising not more than 10% by weight of the fibers used.

4. A method as defined in claim 1, in which the cellulosic fibers are high-grade wood pulp.

5. A method as claimed in claim 1, in which the said mechanical working is carried out by means of stock-preparing apparatus comprising a tank-type pulper having a rotor provided with pulping vanes.

6. A method as defined in claim 1, in which the said presentation of the stock to the web-forming unit is so arranged that the said sheet-material has, when dry, an average basis-weight in the range 50 – 250 gm/m$^2$.

7. A method as defined in claim 1, wherein a coloring agent is incorporated into the smokeable material during the manufacture thereof.

8. A method as defined in claim 7, wherein the coloring agent is a tobacco-like brown or yellow-brown.

9. A method as defined in claim 1, wherein a material for supplying nicotine is incorporated into the smokeable material during the manufacture thereof.

10. A method as defined in claim 9, wherein the nicotine is present as a sulphate, citrate, or citrate-sulphur, malonate or malate.

11. A method as defined in claim 9, wherein a material for reducing the volatility of nicotine is incorporated into the smokeable material during the manufacture thereof.

12. A method as defined in claim 1, wherein up to 2% by weight of citric acid is incorporated into the smokeable material during the manufacture thereof.

13. A method as defined in claim 1, wherein powdered deer tongue or licorice is incorporated into the smokeable material during the manufacture thereof.

14. A method as defined in claim 1, wherein sodium nitrate or potassium nitrate or other inorganic salt is incorporated into the smokeable material during the manufacture thereof and so as to sustain the burning of the smokeable material.

15. A method as defined in claim 1, wherein the said incorporation is carried out by application from an aqueous bath to the said sheet-material.

16. A method as defined in claim 1, wherein tobacco is incorporated into the smokeable material during the manufacture thereof.

17. A method defined in claim 16, wherein the said incorporation of tobacco is prior to the said mechanical working.

18. A method as defined in claim 17, wherein the incorporated tobacco has the form of granules or of fibers.

19. A method as defined in claim 16, wherein the said incorporation of tobacco is into the said stock and subsequent to the said mechanical-working but prior to the said presentation of the stock to the web-forming unit.

20. A method as claimed in claim 19, wherein the incorporated tobacco has the form of ground offal.

21. A method as defined in claim 16, wherein the said incorporation of tobacco is carried out by application from an aqueous bath to the said sheet-material.

22. A method as defined in claim 21, wherein the incorporated tobacco is finely-ground tobacco.

23. A method as defined in claim 16, wherein the incorporated tobacco is incorporated by blending thereof with the said sheet-material or with a mechanically-divided product of that sheet-material.

24. A method as defined in claim 23, wherein the blending is effected by the simultaneous supply, to a shredding device or a cutting device, of tobacco leaf and/or reconstituted tobacco sheet, and the said sheet-material.

25. A method as defined in claim 23, wherein the blending is effected by mixing mechanically-divided tobacco with mechanically-divided said sheet-material.

26. A method as defined in claim 16, wherein the said incorporated tobacco comprises not more than 55% by weight of the smokeable material.

27. A method as defined in claim 1 which includes the step of subjecting the said sheet-material to a creping process.

* * * * *